US010840584B2

(12) United States Patent
Hussain et al.

(10) Patent No.: US 10,840,584 B2
(45) Date of Patent: Nov. 17, 2020

(54) CAVITY BACKED ANTENNA

(71) Applicant: THE SECRETARY OF STATE FOR DEFENCE, Salisbury (GB)

(72) Inventors: Salman Bari Hussain, Salisbury (GB); Nathan Clow, Salisbury (GB); Gary Anthony Pettitt, Salisbury (GB)

(73) Assignee: The Secretary of State for Defence, Salisbury (GB)

( * ) Notice: Subject to any disclaimer, the term of this patent is extended or adjusted under 35 U.S.C. 154(b) by 0 days.

(21) Appl. No.: 16/311,217

(22) PCT Filed: Jul. 18, 2017

(86) PCT No.: PCT/GB2017/000112
§ 371 (c)(1),
(2) Date: Dec. 19, 2018

(87) PCT Pub. No.: WO2018/015705
PCT Pub. Date: Jan. 25, 2018

(65) Prior Publication Data

US 2019/0237857 A1 Aug. 1, 2019

(30) Foreign Application Priority Data

Jul. 22, 2016 (GB) ..... 1612693.0

(51) Int. Cl.
*H01Q 13/18* (2006.01)
*H01Q 1/27* (2006.01)

(52) U.S. Cl.
CPC ..... *H01Q 1/273* (2013.01); *H01Q 13/18* (2013.01)

(58) Field of Classification Search
CPC ..... H01Q 1/273; H01Q 13/18
See application file for complete search history.

(56) References Cited

U.S. PATENT DOCUMENTS 8,253,640 B2 8/2012 Kitayoshi et al.
9,743,823 B1 8/2017 Gitlin et al.
(Continued)

FOREIGN PATENT DOCUMENTS

EP 2680366 A1 1/2014
GB 2539327 A 12/2016
(Continued)

OTHER PUBLICATIONS

United Kingdom Patent Application No. GB1612693.0, Search Report dated Jan. 11, 2017, 4 pages.
(Continued)

*Primary Examiner* — Dimary S Lopez Cruz
*Assistant Examiner* — Noel Maldonado
(74) *Attorney, Agent, or Firm* — Dean W. Russell; Kilpatrick Townsend & Stockton LLP

(57) ABSTRACT

There is provided a method and apparatus for providing a cavity backed antenna suitable for off-body communications. The cavity backed antenna comprising a substantially omnidirectional antenna element (11) mountable upon a user's body such that an underlying bone (17) forms the cavity back plate. The cavity between the antenna element and the underlying bone thereby being filled with soft tissue (14, 15, 16). The cavity backed antenna operating in synergy with the mechanical and electrical characteristics of the body to deliver an overall directional gain pointing away from the user's body.

14 Claims, 5 Drawing Sheets

(56) References Cited

U.S. PATENT DOCUMENTS

| | | | | |
|---|---|---|---|---|
| 2012/0212380 | A1 | 8/2012 | Theobold et al. | |
| 2012/0226197 | A1* | 9/2012 | Sanders | A61F 2/7812 600/587 |
| 2014/0028329 | A1* | 1/2014 | Nennie | A61B 5/0507 324/629 |
| 2014/0125532 | A1 | 5/2014 | Furse et al. | |
| 2014/0253397 | A1* | 9/2014 | Converse | H01Q 1/273 343/718 |
| 2015/0288048 | A1 | 10/2015 | Tang et al. | |
| 2016/0058364 | A1 | 3/2016 | Ionescu et al. | |
| 2016/0190698 | A1 | 6/2016 | Andresen et al. | |

FOREIGN PATENT DOCUMENTS

| | | | |
|---|---|---|---|
| WO | 03009753 | A2 | 2/2003 |
| WO | 2009031149 | A2 | 3/2009 |
| WO | 2009151196 | A1 | 12/2009 |

OTHER PUBLICATIONS

International Patent Application No. PCT/GB2017/000112, International Search Report and Written Opinion dated Oct. 6, 2017, 13 pages.

United Kingdom Patent Application No. GB1711424.0, Combined Search and Examination Report dated Jan. 9, 2018, 8 pages.

Gabriel, C., et al., "The dielectric properties of biological tissues: I. Literature survey," Phys. Med. Biol., 1996, pp. 2231-2249, vol. 41, IOP Publishing Ltd., United Kingdom.

Makinen, Riku M., et al., "Body Effects on Thin Single-Layer Slot, Self-Complementary, and Wire Antennas," IEEE Transactions on Antennas and Propagation, Jan. 2014, pp. 385-392, vol. 62, No. 1, IEEE.

International Patent Application No. PCT/GB2017/000112, International Preliminary Report on Patentability dated Jan. 31, 2019, 8 pages.

* cited by examiner

CAVITY BACKED ANTENNA

TECHNICAL FIELD OF THE INVENTION

This invention relates to the field of body-worn antennas. In particular this invention describes a cavity backed antenna, and method for its production, that mitigates the negative effects of body proximity on antenna performance, such that the cavity backed antenna has particular suitability for off-body communications roles.

BACKGROUND TO THE INVENTION

Body-wearable antennas have become established in various applications where there is a requirement for transmitting and receiving wireless signals, whilst the user remains essentially "hands-free" and maintains a high degree of freedom of movement. Examples of such applications include civil and military communications, search and rescue, and medical diagnostics. The requirement for thin antenna structures worn close to the body is increasing as a result of increasing user demands including, but not limited to, comfort and discreteness. The size, weight, profile and positioning of a body-wearable antenna can affect the user's willingness to wear the antenna over a prolonged period. Furthermore, applications such as biological sensing, biotelemetry and radio tracking of animals are driving the requirement for ever thinner antenna structures.

For particular applications, the body can offer unique benefits for body-worn antennas. For example EP2680366 (GN ReSound A/S) discloses an antenna system for a wireless body area network, particularly forming part of a hearing aid. The antenna may comprise a slot provided in an electrically conductive material (slot antenna) such that when in use the slot extends parallel to the surface of the body. Upon excitation the slot is configured to emit electromagnetic radiation that then propagates along the surface of the body to be received by a second device. In US20160058364A1 a disclosure is made of an antenna element fixed directly to the skin, whereby the antenna element experiences an induced impedance change that is beneficial for measuring RF radiation from an external source that is backscattered from the skin. The backscattered radiation is used to perform local monitoring of the user, in particular to determine the hydration level of the user.

However, and particularly applicable to off-body communications (i.e. transmitting or receiving radiation between an antenna or device on the body and another target or device remote from the body), it is well known that the proximity of the human body can have a negative effect on the performance of an antenna. In particular, absorption and dissipation of radiated power by the body will decrease the antennas' efficiency, distort radiation patterns and cause detuning. Increasing power input to overcome losses owing to body proximity may not be an option, owing to the resultant radiation hazard to the user and the consequent increased size and weight of the power source. Body effects on antenna performance are discussed further in R. M. Mäkinen and T. Kellomäki "*Body Effects on Thin Single-layer Slot, Self-Complementary, and Wire Antennas*" IEEE Trans. Antennas Propagat., vol. 62, no. 1, pp. 385-392, January 2014.

Therefore it is an aim of the invention to provide a cavity backed antenna, and method for its production, that mitigates the negative effects of body proximity on antenna performance, such that the cavity backed antenna has particular suitability for off-body communications roles.

SUMMARY OF THE INVENTION

According to a first aspect of the invention there is provided a cavity backed antenna for off-body communications, the cavity backed antenna comprising:

a. an antenna element;
b. a cavity filler; and
c. a cavity back plate;

wherein the antenna element is a substantially omnidirectional antenna element arranged to be mountable on a user's body above an underlying bone, such that the cavity back plate comprises the underlying bone and the cavity filler comprises the soft tissue between the antenna element and the underlying bone, such that, when in use, the cavity backed antenna provides an overall directional gain pointing away from the user's body.

According to a second aspect of the invention there is provided a method of producing a cavity backed antenna, the cavity backed antenna comprising a substantially omnidirectional antenna element, a cavity filler and a cavity back plate, the method comprising the following steps:

a. selecting a position upon a user's body above an underlying bone;
b. determining mechanical and electrical characteristics of the user's body at the selected position;
c. providing a substantially omnidirectional antenna element, configured for the selected position according to the determined characteristics; and
d. applying the substantially omnidirectional antenna element at the selected position; such that the substantially omnidirectional antenna element forms the front of a cavity backed antenna, the cavity back plate comprising the underlying bone, and the cavity filler comprising the soft tissue between the substantially omnidirectional antenna element and the underlying bone.

A person skilled in the art will understand an omnidirectional antenna element to be an antenna element that can radiate or receive energy in all directions. A substantially omnidirectional antenna element is, with respect to the invention described herein, intended to mean an antenna element that can radiate or receive energy in both substantially forward and substantially rearward directions relative to the plane of the antenna element itself (both directions being opposing directions substantially perpendicular to the plane of the antenna). Examples of substantially omnidirectional antenna elements include slot, folded dipole and spiral antennas. For communications applications, it may be desirable to radiate energy in only the substantially forwards direction (i.e. towards the intended target or recipient, and away from the user's body). In order to achieve this, a substantially omnidirectional antenna may be provided in a 'cavity backed' configuration.

A cavity backed antenna is designed to radiate energy in a specific direction and comprises a substantially omnidirectional antenna element and a cavity back plate. The substantially omnidirectional antenna element forms the front of a cavity. The back plate is arranged to reflect energy radiated substantially rearwards from the antenna element, towards the substantially forwards direction (the back plate forms the rear of the cavity). Characteristics of the cavity may affect the behaviour of the antenna, for instance the volume of the cavity typically influences the antenna bandwidth. The cavity may be completely or partially filled with a filler (optionally air or other material or mixture). A person skilled in the art will understand that the properties of a cavity filler can allow for a reduction (relative to a vacuum filled or air filled cavity) in the height of the cavity for particular modes of operation.

Soft tissue is understood to comprise tendons, ligaments, fascia, skin, fibrous tissues, fat, muscles, nerves, blood vessels, or any combination thereof. Other connective or non-connective tissues may be apparent to a person skilled in the art. Different types of soft tissue may have different electrical characteristics (for instance permittivity and conductivity) and different mechanical characteristics (for instance depth). Soft tissue may comprise a mixture of tissue types in a single layer, or may comprise multiple layers of different tissue types. In accordance with the invention the cavity back plate comprises bone and may be a single bone, multiple bones, or a portion of a bone, within a user's body.

The substantially omnidirectional antenna element is applied to a user's body so as to achieve the benefit of the invention. The term "user's body" implies the individual upon which the antenna element is placed, and can refer to any body part or multiple body parts on that individual, wherein a body part typically means a head, arm, hand, leg, foot or torso. The "user's body" may also refer to an animal body. A substantially omnidirectional antenna element may be placed at any position on a body part that provides an underlying bone and consequently an effective cavity is formed between the antenna element and at least a portion of the underlying bone or bones.

In accordance with the invention, underlying bone is used, for example in the arm or leg, to reflect incident energy to provide a higher realised and directive gain in the substantially forward direction (off/away from the body). The space between the bone and the substantially omnidirectional antenna element acts like a filled cavity. The soft tissue within the cavity comprises multiple regions of differing permittivity and conductivity. At the boundaries of these regions, energy from the substantially omnidirectional antenna element is reflected. The soft tissue thus achieves a similar effect to the walls of a conventional cavity backed antenna, containing the radiation and reflecting it towards a direction away from the user's body. As a result of the cavity being filled with soft tissue (i.e. skin, fat and muscle), the cavity height can be reduced, compared to an air-filled cavity. Thereby the cavity backed antenna provides an overall directional gain pointing away from the user's body i.e. the gain of the cavity backed antenna is concentrated in a direction away from the user upon which the substantially omnidirectional antenna element is mounted. Such a directional gain allows for greater power to be radiated away from the body in a particular direction. Alternatively such a directional gain allows for greater power to be received from an off-body source that is radiating towards the user. In particular when transmitting, radiation emitted towards the body by the substantially omnidirectional antenna element will be reflected by the cavity back plate, thereby contributing to the overall off-body effect.

In an embodiment of the invention the substantially omnidirectional antenna element is placed in direct contact with the soft tissue. The term "direct contact" is used to imply that the antenna element is applied directly to the soft tissue without intermediate adhesive layer or spacer. Alternatively an antenna element may be placed in close proximity to, but not in direct contact with, soft tissue, through use of an adhesive layer, air gap or other appropriate spacer material. The invention utilises the characteristics of soft tissue to beneficial effect, contrary to conventional teaching which states that the efficiency of all antenna elements is significantly reduced if they are placed in close proximity to, or in direct contact with, soft tissue.

The substantially omnidirectional antenna element may be a single layer of electrically conducting material. The electrically conducting material may comprise at least one elongate slot so as to form a slot antenna element. A basic slot antenna comprises a thin metal conducting sheet (the ground) with a rectangular slot cut through it. The size of the ground and the shape of the slot are crucial to tuning the antenna to the desired operating frequency. A basic slot antenna on the body can be used to couple surface waves onto a platform, such as a human body, and provide short range communications i.e. RFID solutions. By configuring a substantially omnidirectional antenna—which may be a slot antenna—in accordance with the invention, improved performance can be achieved with respect to range, when used for applications such as off-body communications.

In some embodiments of the invention the slot antenna element may be orientated such that the slot is aligned normal to a length of the underlying bone. The length of the underlying bone is intended to mean the longest dimension of the underlying bone, such a configuration having been shown by the inventor to provide improved directional gain performance.

In some embodiments of the invention the cavity backed antenna may operate at frequencies equal to or below 6 GHz, or equal to or below 5 GHz. Owing to an increase in loss effects above 1 GHz, preferred embodiments of the invention operate within the frequency range of 150 MHz to 1 GHz.

Each substantially omnidirectional antenna element may be applied in the form of a temporary tattoo to provide a short term transmit/receive capability. The temporary tattoo may be applied directly to the skin or other soft tissue of a user. The temporary tattoo may fade or deteriorate over time, especially where soft tissue, such as the skin, is liable to flex. The temporary tattoo may be readily removed when no longer needed. Each temporary tattoo may be applied in the form of an electrically conductive pigment, paint or ink, by freehand or using a prepared stencil or embossed stamp. For example a metal impregnated ink or paint may be used. Alternatively it may be applied as a pre-formed shape, such as a foil transfer or decal. In this case a preformed single layer slot antenna element, supported on a flexible substrate sheet, is readily transferable from the substrate sheet to a position on the skin on a user's body using known techniques such as water-slide transfers to provide the benefit of the invention.

The substantially omnidirectional antenna element or antenna elements may be connected individually to a microstrip feed line that is integrated into clothing, or applied to the body or clothing as a thin substrate sheet. Alternatively each antenna element may be connected to a coaxial feed line.

It may be necessary to determine the required mechanical characteristics of the user's body which comprise the distances between the antenna element and the bone or bones in a particular area of the body, or the depth of soft tissue layers. These characteristics may be used to define, for instance, the height of a cavity, which itself is important in determining the gain and efficiency of the antenna element. It may also be necessary to determine the electrical characteristics of the user's body which comprise the permittivity and conductivity of the soft tissue (skin, fat and muscle) between the antenna element and the bone, the soft tissue acting as a cavity filler that may be exploited to effectively reduce the cavity height for required frequencies of operation.

It is generally understood that different parts of a user's body have different mechanical and electrical characteristics. Furthermore it is understood that different users may have different mechanical and electrical characteristics for identical body positions. In some embodiments of the invention a position on a user's body is selected, with the mechanical and electrical characteristics of the body position then determined directly. A user-specific antenna element may then be designed based on the determined characteristics for placement on that user's body. In practical embodiments of the invention, a body part of a user is selected, with average mechanical and electrical characteristics for that body part—that are not necessarily specific to the user—used to influence the positioning of, and to optimise the operation of, a pre-selected antenna element. For instance, in applications where frequency of operation is already chosen and cannot be changed, a specific slot antenna element may operate with optimum gain at a specific position or orientation on a body part. In applications where the positioning of a slot antenna on a body part is already chosen and cannot be changed, a specific frequency of operation may offer optimal gain for a particular orientation at the given position and therefore could be chosen.

An academic paper (Gabriel et al, 1996, *Phys. Med. Biol.* 41 2231, *"The dielectric properties of biological tissues: I. Literature survey"*) provides values for the electrical properties of various biological tissues at sampled frequencies between 10 kHz and 10 GHz. The inventor has simulated the performance of a slot antenna operating within regions of the preferred frequency range of 150 MHz-1 GHz when placed on various body parts. Average values for the permittivity and conductivity of particular soft tissue types as used in the simulations are provided in Table 1. Average tissue thicknesses and total cavity heights for the lower arm, upper arm and lower leg as used in the simulations are provided in Table 2. These values may be used as average values for the mechanical and electrical characteristics of a user's body in further applications of the invention.

TABLE 1

Average permittivity and conductivity values for soft tissues.

| Type | Permittivity | Conductivity |
|---|---|---|
| Skin | 45.240 | 0.699 |
| Fat | 5.514 | 0.052 |
| Muscle | 58.605 | 1.054 |
| Bone (cortical) | 12.440 | 0.152 |

TABLE 2

Average soft tissue thicknesses for specific body parts.

| Body Part | Skin Thickness (mm) | Fat Thickness (mm) | Muscle Thickness (mm) | Total Cavity Height (mm) |
|---|---|---|---|---|
| Lower Arm | 5 | 5 | 20 | 30 |
| Upper Arm | 5 | 5 | 40 | 50 |
| Upper Leg | 5 | 5 | 130 | 140 |

BRIEF DESCRIPTION OF THE DRAWINGS

An embodiment of the invention will now be described by way of example only and with reference to the accompanying drawings, in which.

The drawings are purely illustrative and are not to scale. Same or similar reference signs denote same or similar features.

DETAILED DESCRIPTION

Figure 1A:
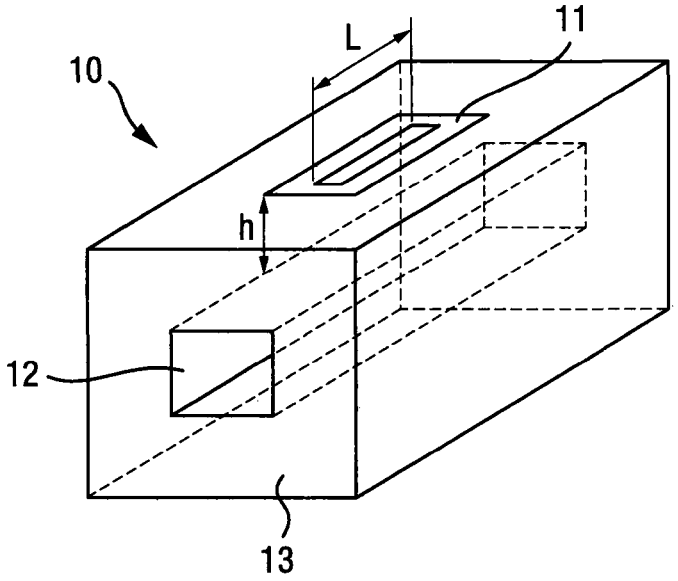
FIG. 1*a* shows a 3D square model of a slot antenna element applied to a body part in accordance with an embodiment of the invention.

FIG. 1*a* shows a 3D square model 10 of a slot antenna element 11 applied to a body part comprising an elongate bone 12 surrounded by soft tissue (skin, fat and muscle) 13. The shape of the slot antenna element 11 is based on the standard rectangular slot, but the person skilled in the art will understand that other slot shapes can be employed.

Traditional cavity backed slot antennas designed to operate at a particular wavelength ($\lambda$) require a cavity height that is substantially half a wavelength ($\lambda/2$) if the cavity is filled with air. However, this becomes less practical for body mounted applications as the wavelength increases. The cavity height 'h' can be reduced by the presence of a filler material having a higher relative permittivity ($\varepsilon_r$) than air. In this case the cavity is filled with soft tissue (skin, fat and muscle) 13 which, combined, have a very high value of $\varepsilon_r$. This effectively loads the antenna and reduces the height 'h' of the required cavity. The combined permittivity and conductivity of a body part may vary between users. As a result, each antenna element may require tuning to a given user. The cavity height 'h' determines the matched frequency, bandwidth and realised gain of the effective cavity backed antenna.

Figure 1B:
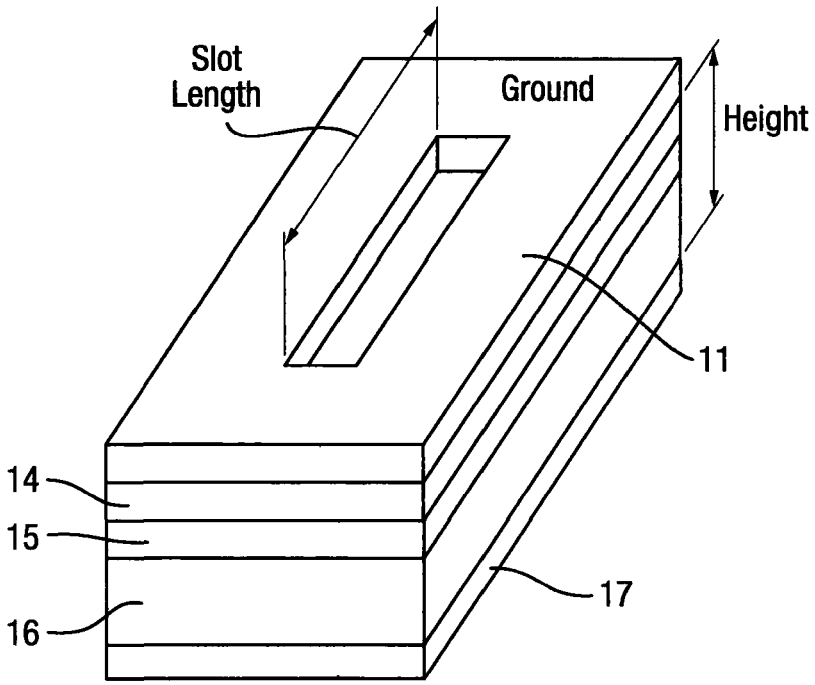
FIG. 1*b* shows a 3D model of an embodiment of the cavity backed antenna in accordance with the invention.

FIG. 1*b* shows a 3D model of a cavity backed antenna in accordance with an embodiment of the invention. This cavity backed slot antenna features a slot antenna element 11, a cavity back plate comprising bone 17, a cavity filler comprising skin 14, fat 15 and muscle 16.

Figure 2A:
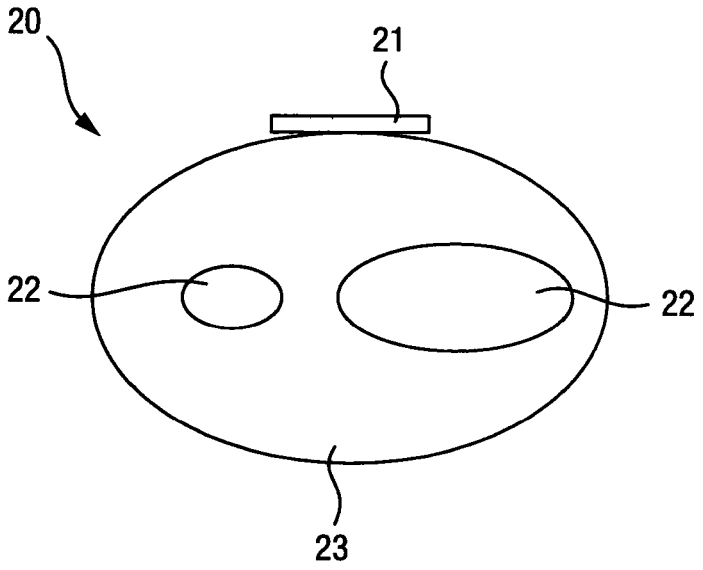
FIG. 2*a* shows a schematic cross section of a body part featuring two bones with antenna element applied.
Figure 2B:
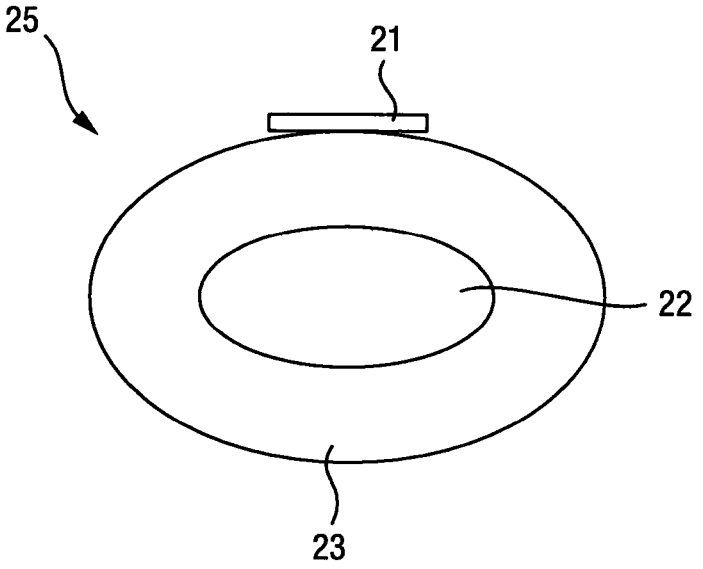
FIG. 2*b* shows a schematic cross section of a body part featuring one bone with antenna element applied.

In practical applications of the invention, the substantially omnidirectional antenna element may be placed on a body part that is oval rather than rectangular (as per FIG. 1*a* and FIG. 1*b*). Further to this, a body part may feature a portion of a bone, or multiple bones acting as a cavity back plate. Therefore substantially realistic oval shaped objects were used in simulations to confirm that the invention was transferrable from the square body part representation, and, to determine whether multiple bones affect the performance of the invention. FIG. 2*a* is a schematic representation of a cross section of a body part 20 having two elongate bones 22 and soft tissue 23 and having a slot antenna element 21 applied to it's outer surface. Simulations performed by the inventor have shown that in this configuration the larger bone is more dominant and affects the antenna performance characteristics the most. FIG. 2*b* is a schematic representation of a cross section of a body part 25 having one elongate bone 22 and soft tissue 23 and having a slot antenna element 21 applied to the outer surface. No significant differences in antenna characteristics or performance were observed between the dual and single bone simulations.

Figure 3A:
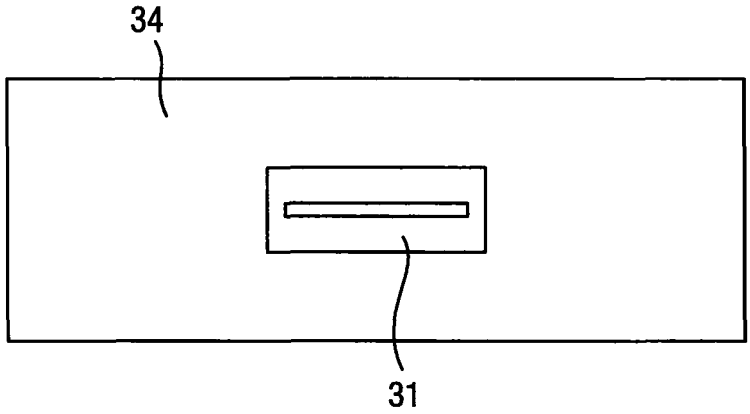
FIG. 3 shows schematic diagrams of a body part having a slot antenna applied in different orientations.
Figure 3B:
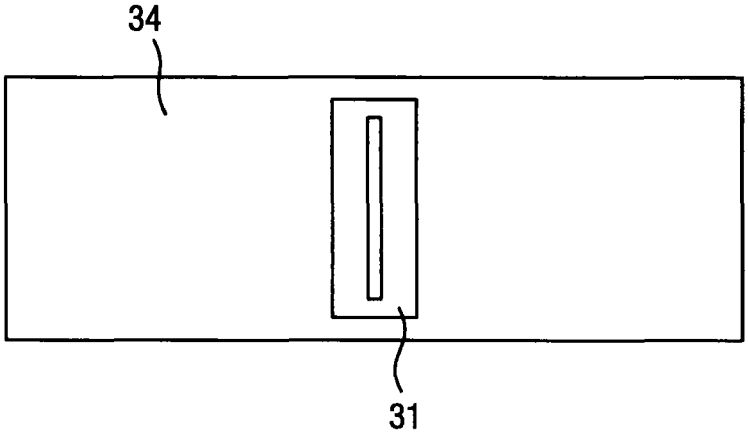

The inventor has determined that, for embodiments of the invention using a slot antenna, by placing the antenna at different orientations relative to the length of the bone, affected performance. This was mainly owing to the orientation of the Electric (E) and Magnetic (H) fields. In a slot antenna the E-field component is normal to the length of the slot, and the H-field is adjacent to the slot. Simulations showed that the orientation of the E-field was crucial to achieve improved gain. FIG. 3*a* shows a body part 34 having a slot antenna 31 applied with the slot aligned along the length of the body part. In this orientation the E-field only sees a fraction of the bone reducing the effective size of the back plate of the cavity, therefore more of the energy is absorbed. FIG. 3*b* shows a body part 34 having a slot antenna 31 applied with the slot aligned normal to the length of the body part. In this orientation the E-field sees more of the bone increasing the effective size of the cavity back plate, and thereby increasing the amount of incident energy reflected in a forward direction. To achieve improved performance the E-field should be in line with the length of the bone.

Figure 4A:
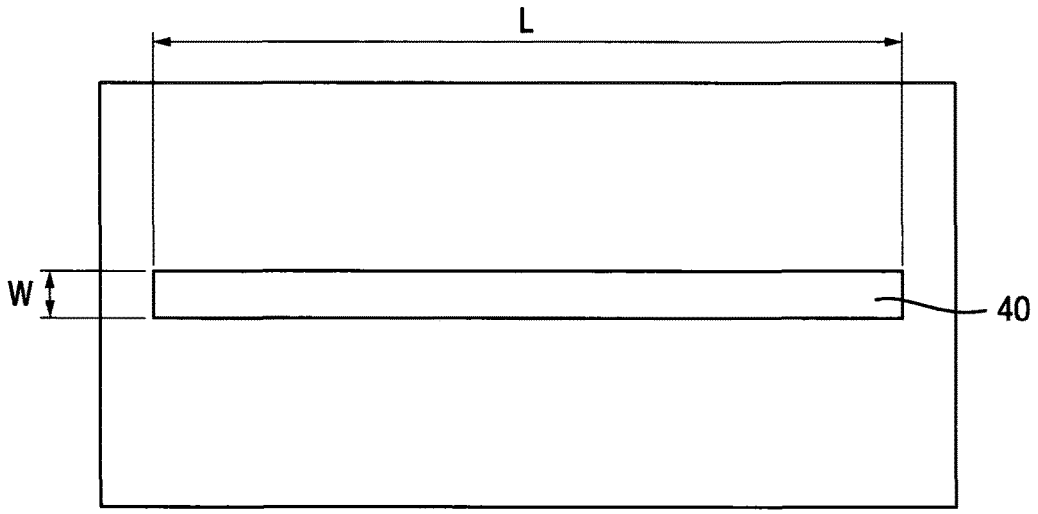
FIG. 4*a* shows a 2D view of a slot antenna element used in simulating an embodiment of the invention.
Figure 4B:
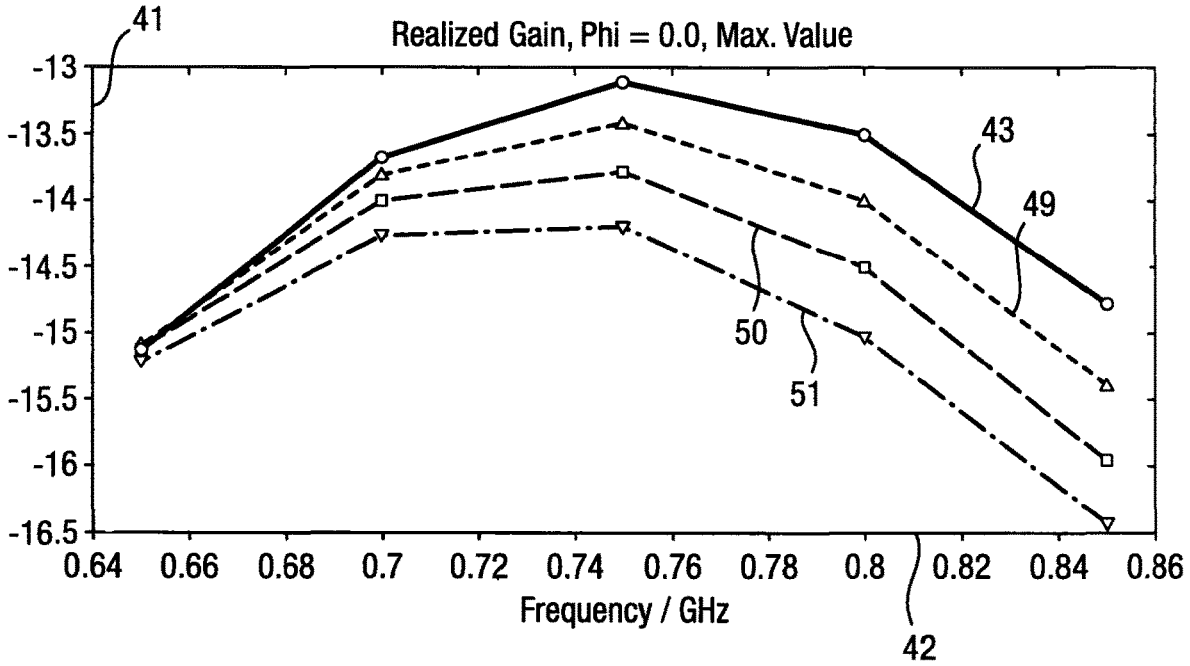
FIG. 4*b* is a graph showing the effect of cavity height on realised gain, for sampled points within a frequency band of 650-850 MHz, for a slot antenna placed on the lower arm.
Figure 4C:
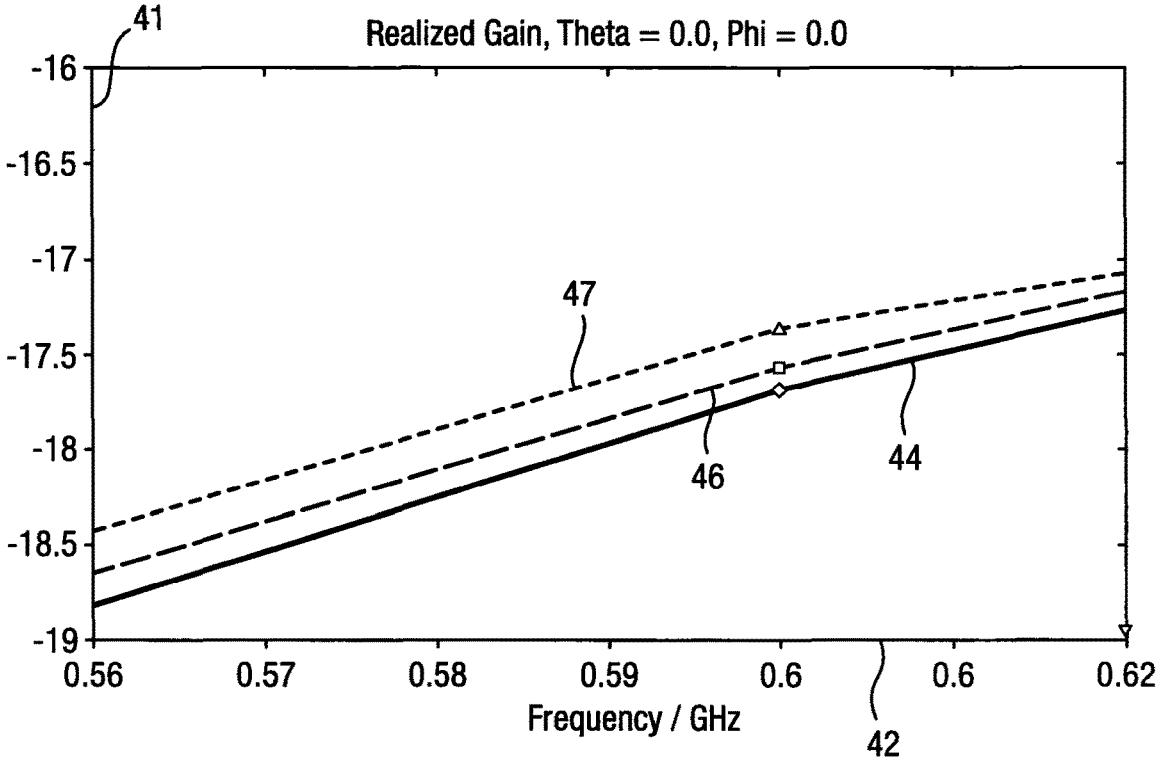
FIG. 4*c* is a graph showing the effect of cavity height on realised gain, for sampled points within a frequency band of 560-620 MHz, for a slot antenna placed on the upper arm.
Figure 4D:
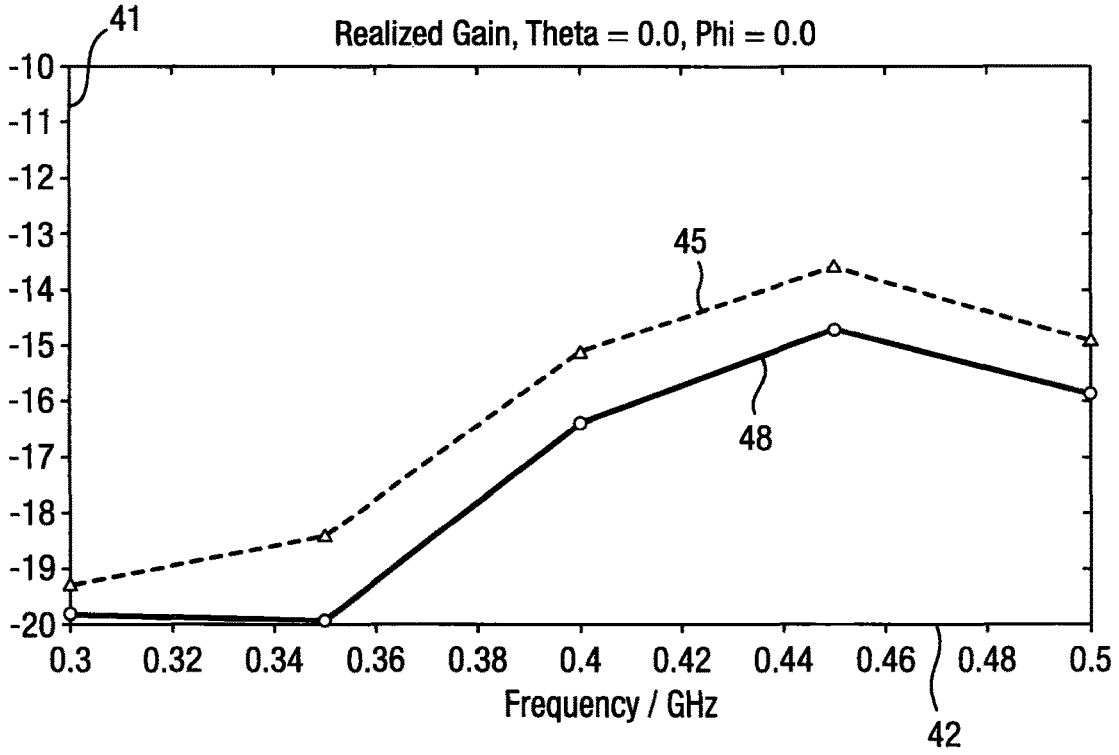
FIG. 4*d* is a graph showing the effect of cavity height on realised gain, for sampled points within a frequency band of 300-500 MHz, for a slot antenna placed on the upper leg.

FIG. 4*a* shows a 2D view of a slot antenna element used in simulations of the invention. The antenna element has an overall length of 80 mm and width of 40 mm. The slot 40 has a length 'L' of 70 mm and a width 'W' of 1.75 mm. The simulations involved placing the slot antenna element on lower arm, upper arm and upper leg body parts, above at least one underlying bone, so as to form a cavity backed antenna, the cavity filled with soft tissue comprising skin, fat and muscle. The body parts were modelled as having representative oval cross-sections. The slot of the slot antenna was aligned normal to the length of the underlying bone in accordance with FIG. 3*b*. Average mechanical and electrical characteristics for the body parts were determined and used in the simulations. The realised antenna gain for different frequencies was determined in each case. FIG. 4*b*-FIG. 4*d* show results of the simulations.

FIG. 4*b* shows a graph of realised antenna gain 41 versus frequency 42 for a slot antenna element applied to the lower arm in accordance with the invention. The lower arm was modelled as having length 300 mm, width 80 mm and overall depth 65 mm. The lower arm was modelled as having two bones—the Ulna and Radius—both extending the full length of the lower arm and forming the cavity back plate. The depths/widths for the Ulna and Radius were 10 mm/15 mm and 20 mm/35 mm respectively. The cavity filler was modelled, as a baseline, as comprising skin of thickness 5 mm, above, fat of thickness 5 mm, above, muscle of thickness 20 mm. The permittivity of skin, fat, muscle, bone, was modelled to be 45.240, 5.514, 58.605, 12.440, respectively. The conductivity of skin, fat, muscle, bone, was modelled to be 0.699, 0.052, 1.054, 0.152, respectively. Different lines represent results for different cavity heights: 23 mm from the fat and muscle boundary 43; 24 mm from the fat and muscle boundary 49; 25 mm from the fat and muscle boundary 50; 26 mm from the fat and muscle boundary 51. When the cavity height was varied it was noted that there was approximately a 1 dB change in gain across a 3 mm range of cavity heights. The graph shows that in this embodiment of the invention, across a frequency range of 650-850 MHz and for the modelled cavity depths, the realised gain was in the region of ~−14 dBi. The graph also shows that for peak realised gain, the preferred frequency of operation in this embodiment would be ~750 MHz.

FIG. 4*c* shows a graph of realised antenna gain 41 versus frequency 42 for a slot antenna element applied to the upper arm in accordance with the invention. The upper arm was modelled as having length 330 mm and diameter 90 mm. The upper arm was modelled as having one bone—the Humerus—extending the full length of the upper arm and forming the cavity back plate. The bone diameter for the Humerus was modelled as 30 mm. The cavity filler was modelled, as a baseline, as comprising skin of thickness 5 mm, above, fat of thickness 5 mm, above, muscle of thickness 40 mm. The permittivity of skin, fat, muscle, bone, was modelled to be 45.240, 5.514, 58.605, 12.440, respectively. The conductivity of skin, fat, muscle, bone, was modelled to be 0.699, 0.052, 1.054, 0.152, respectively. Different lines represent results for different cavity heights; 10 mm from the fat and muscle boundary 44; 15 mm from the fat and muscle boundary 46; 20 mm from the fat and muscle boundary 47. The graph shows that in this embodiment of the invention, across a frequency range of 560-620 MHz and for the modelled cavity depths, the realised gain was in the region of ~18 dBi. The graph also shows that for peak realised gain, the preferred frequency of operation in this embodiment would be at least ~620 MHz.

FIG. 4*d* shows a graph of realised antenna gain 41 versus frequency 42 for a slot antenna element applied to the upper leg in accordance with the invention. The upper leg was modelled as having length 500 mm, width 280 mm, thickness 280 mm. The upper leg was modelled as having one bone—the Femur—extending the full length of the upper leg and forming the cavity back plate. The bone diameter for the Femur was modelled as 80 mm. The cavity filler was modelled, as a baseline, as comprising skin of thickness 5 mm, above, fat of thickness 5 mm, above, muscle of thickness 130 mm. The permittivity of skin, fat, muscle, bone, was modelled to be 45.240, 5.514, 58.605, 12.440, respectively. The conductivity of skin, fat, muscle, bone, was modelled to be 0.699, 0.052, 1.054, 0.152, respectively. Different lines represent results for different cavity heights; 100 mm from the fat and muscle boundary 45; 115 mm from the fat and muscle boundary 48. The graph shows that in this embodiment of the invention, across a frequency range of 300-500 MHz and for the modelled cavity depths, the realised gain varied significantly with peak realised gain in the region of ~−15 dBi. The graph also shows that for peak realised gain, the preferred frequency of operation in this embodiment would be in the region of ~450 MHz.

According to FIG. 4*b* to FIG. 4*d*, different body parts may operate better at different frequencies, for a fixed substantially omnidirectional antenna element forming part of a cavity backed antenna according to the invention. A typical wire antenna worn on the body may provide realised gain in the region of −19 dBi. The inventor has shown that the invention can provide performance superior to this, achieving realised gain of −14 dBi in some embodiments. Using this method improves performance over conventional omnidirectional antennas placed in close proximity to the body for off-body communications.

The invention claimed is:

1. A cavity backed antenna for off-body communications, the cavity backed antenna comprising: an antenna element tuned to a predetermined operating frequency; wherein the antenna element is a substantially omnidirectional antenna element configured such that when mounted on a user's body above an underlying bone, the underlying bone functions as a cavity back plate and soft tissue between the antenna element and the underlying bone functions as a cavity filler, such that, when in use, the cavity filler is resonant at the predetermined operating frequency and the cavity backed antenna provides an overall directional gain pointing away from the user's body.

2. A cavity backed antenna according to claim 1 wherein the antenna element comprises a single layer of electrically conductive material.

3. A cavity backed antenna according to claim 2 wherein at least one elongate slot is provided in the electrically conductive material to form a slot antenna element.

4. A cavity backed antenna according to claim 3 wherein the elongate slot is configured to be aligned normal to a length of the underlying bone.

5. A cavity backed antenna according to claim 1 wherein the cavity backed antenna operates at frequencies equal to or below 6 GHz.

6. A cavity backed antenna according to claim 1, wherein the cavity backed antenna operates at frequencies equal to or below 5 GHz.

7. A cavity backed antenna according to claim 1 wherein the cavity backed antenna operates in the frequency range 150 MHz- 1 GHz.

8. A cavity backed antenna according to claim 1 wherein the antenna element comprises a temporary tattoo.

9. A cavity backed antenna according to claim 8 wherein the antenna element comprises metal impregnated ink or paint.

10. A cavity backed antenna according to claim 1 wherein the antenna element is connected to a microstrip feed line.

11. A cavity backed antenna according to claim 1 wherein the antenna element is connected to a coaxial feed line.

12. A method of producing a cavity backed antenna, the cavity backed antenna comprising a substantially omnidirectional antenna element, a cavity filler and a cavity back plate, the method comprising the following steps:

a. selecting a position upon a user's body above an underlying bone;

b. determining mechanical and electrical characteristics of the user's body at the selected position;

c. providing a substantially omnidirectional antenna element, configured for the selected position according to the determined characteristics; and d. applying the substantially omnidirectional antenna element at the selected position; such that the substantially omnidirectional antenna element forms the front of a cavity backed antenna, the cavity back plate comprising the underlying bone, and the cavity filler comprising the soft tissue between the substantially omnidirectional antenna element and the underlying bone.

13. A method of producing a cavity backed antenna according to claim 12 wherein within the step of applying the substantially omnidirectional antenna element, the substantially omnidirectional antenna element is applied directly to the soft tissue.

14. A method of producing a cavity backed antenna according to claim 12 wherein (a) the step of determining mechanical and electrical characteristics of the user's body at the selected position comprises determining a resonant frequency of the cavity filler and (b) the substantially omnidirectional antenna element is tuned to an operating frequency to which the resonant frequency is resonant.

* * * * *